US010295304B1

(12) United States Patent
Kincel et al.

(10) Patent No.: US 10,295,304 B1
(45) Date of Patent: May 21, 2019

(54) FIREARM HANDGUARD ASSEMBLY

(71) Applicant: BRAVO COMPANY MFG. INC., Hartland, WI (US)

(72) Inventors: Eric Stephen Kincel, Coeur d'Alene, ID (US); Jeffrey James O'Brien, Coeur d'Alene, ID (US)

(73) Assignee: Bravo Company Mfg, Inc., Hartland, WI (US)

( * ) Notice: Subject to any disclaimer, the term of this patent is extended or adjusted under 35 U.S.C. 154(b) by 0 days.

(21) Appl. No.: 16/178,937

(22) Filed: Nov. 2, 2018

Related U.S. Application Data

(63) Continuation-in-part of application No. 15/885,071, filed on Jan. 31, 2018, now Pat. No. 10,126,094, which is a continuation of application No. 15/701,982, filed on Sep. 12, 2017, now abandoned, which is a continuation of application No. 15/153,464, filed on May 12, 2016, now Pat. No. 9,791,239.

(51) Int. Cl.
*F41C 23/16* (2006.01)
*F41A 21/48* (2006.01)
*F41A 5/18* (2006.01)

(52) U.S. Cl.
CPC ..... *F41C 23/16* (2013.01); *F41A 5/18* (2013.01); *F41A 21/485* (2013.01)

(58) Field of Classification Search
CPC ..... F41C 23/16; F41A 11/00; F41A 11/02; F41A 3/66; F41A 5/18; F41A 21/482
USPC ..... 42/71.01, 75.01, 75.02, 75.03
See application file for complete search history.

(56) References Cited

U.S. PATENT DOCUMENTS

| | | | |
|---|---|---|---|
| 2,078,010 | A | 4/1937 | Meepos |
| 2,102,964 | A | 12/1937 | Mosseberg |
| 3,066,375 | A | 12/1962 | Knowles et al. |
| 3,177,587 | A | 4/1965 | Hart |
| 3,512,653 | A | 5/1970 | Erismann |
| 3,559,940 | A | 2/1971 | Kruzell |
| 3,798,818 | A | 3/1974 | Casull |
| 3,844,627 | A | 10/1974 | Gutner |
| 3,861,070 | A | 1/1975 | Wild et al. |
| 4,167,884 | A | 9/1979 | Santanna |

(Continued)

FOREIGN PATENT DOCUMENTS

| | | |
|---|---|---|
| EP | 1832835 | 9/2007 |
| WO | 2013010515 | 1/2013 |

*Primary Examiner* — Joshua E Freeman
(74) *Attorney, Agent, or Firm* — Michael Best & Friedrich LLP

(57) ABSTRACT

A handguard assembly for a firearm includes a handguard with an internal clamping area. A single-piece index block includes a securing portion for connecting to the handguard and an indexing extension for engaging an indexing feature on the upper receiver of the firearm. The handguard includes internal ribs that provide discrete clamping surfaces for engaging a barrel nut of the firearm. Connecting the index block to the handguard generates a continuous clamping action in the handguard which acts through the ribs to apply a radially-directed circumferentially-applied clamping force on a barrel nut through the discrete clamping surfaces. The indexing feature of the index block engages an indexing feature of the upper receiver to ensure proper alignment of the handguard and the upper receiver.

18 Claims, 17 Drawing Sheets

(56) References Cited

U.S. PATENT DOCUMENTS 4,663,875 A 5/1987 Tatro
4,905,396 A 3/1990 Bechtel
4,959,908 A 10/1990 Weyrauch
5,078,215 A 1/1992 Nau
5,590,484 A 1/1997 Mooney et al.
5,603,594 A 2/1997 Lincoln
5,632,108 A 5/1997 Ruger et al.
6,609,321 B2 8/2003 Faifer
6,836,990 B2 1/2005 Shiloni
6,874,269 B2 4/2005 Chen et al.
7,216,451 B1 5/2007 Troy
7,325,352 B2 2/2008 Matthews et al.
7,430,829 B2 10/2008 Murello
7,464,495 B2 12/2008 Cahill
D613,811 S 4/2010 Swan
7,712,242 B2 5/2010 Matthews et al.
7,716,865 B2 5/2010 Daniel et al.
7,770,317 B1 8/2010 Tankersley
7,793,452 B1 9/2010 Samson et al.
D636,453 S 4/2011 Fitzpatrick et al.
D641,450 S 7/2011 Ding
7,971,384 B2 7/2011 Lippard
8,006,430 B2 8/2011 Wang
8,051,595 B2 11/2011 Hochstrate et al.
8,141,289 B2 * 3/2012 Gomez ..... F41C 23/16 42/90
8,201,353 B1 6/2012 Swan
8,245,428 B2 8/2012 Griffin
8,312,668 B2 11/2012 Kincel
8,438,770 B2 5/2013 Troy
8,490,316 B2 7/2013 Kincel et al.
8,539,708 B2 9/2013 Kenney et al.
8,578,647 B2 11/2013 Storch et al.
8,607,490 B1 12/2013 Zinsner
D703,286 S 4/2014 Chen et al.
8,739,448 B2 6/2014 Kimmel et al.
8,752,320 B2 6/2014 Masters
D710,964 S 8/2014 Chvala
8,819,980 B2 * 9/2014 Geissele ..... F41C 23/16 42/71.01
D717,907 S 11/2014 Montes
D717,908 S 11/2014 Montes
D720,421 S 12/2014 Chen
8,904,691 B1 12/2014 Kincel
D721,407 S 1/2015 Chu
8,925,236 B1 1/2015 Mayberry et al.
D722,356 S 2/2015 Keller et al.
D725,723 S 3/2015 Eddie
9,103,625 B2 8/2015 Masters
9,157,697 B2 * 10/2015 Leclair ..... F41C 23/16
D744,054 S 11/2015 Peterson et al.
D746,399 S 12/2015 Folkestad, II et al.
D746,936 S 1/2016 Huang
9,239,209 B2 1/2016 Mayberry et al.
9,239,210 B2 1/2016 Mayberry et al.
D749,181 S 2/2016 Hu
9,297,599 B2 3/2016 Underwood et al.
9,303,949 B1 * 4/2016 Oglesby ..... F41A 3/66
D755,338 S 5/2016 Slank
D757,201 S 5/2016 Meier
D757,204 S 5/2016 Chow et al.
D757,878 S 5/2016 Barfoot et al.
9,377,274 B2 6/2016 Kincel
9,383,163 B2 7/2016 Kincel et al.
9,389,043 B1 * 7/2016 Zhang ..... F41C 23/16
9,429,388 B2 8/2016 Mayberry et al.
D768,800 S 10/2016 Willits
9,459,078 B1 10/2016 Kincel
9,464,865 B2 10/2016 Shea et al.
9,470,472 B2 10/2016 Kincel et al.
9,476,672 B2 10/2016 Wells et al.
D771,216 S 11/2016 Dubois
9,523,554 B2 12/2016 Mayberry et al.
D779,013 S 2/2017 Cheng et al.
D779,014 S 2/2017 Cheng et al.
9,581,412 B2 2/2017 Cheng et al.
9,599,439 B1 3/2017 Sylvester
D783,760 S 4/2017 Pavlick
D783,761 S 4/2017 Pavlick
D785,743 S 5/2017 Pavlick
9,696,112 B2 7/2017 Gottzmann et al.
9,709,358 B2 7/2017 Kincel
D795,986 S 8/2017 Frederickson et al.
9,791,239 B1 10/2017 Kincel et al.
2001/0045046 A1 11/2001 Otteman
2004/0009034 A1 1/2004 Miller
2005/0268512 A1 12/2005 Battaglia
2006/0191183 A1 8/2006 Griffin
2008/0092422 A1 * 4/2008 Daniel ..... F41C 23/16 42/90
2008/0301994 A1 12/2008 Langevin et al.
2009/0000175 A1 1/2009 Potterfield et al.
2009/0100734 A1 4/2009 Swan et al.
2009/0178325 A1 7/2009 Veilleux
2010/0122485 A1 5/2010 Kincel
2010/0242332 A1 9/2010 Teetzel et al.
2010/0319231 A1 12/2010 Stone et al.
2011/0032694 A1 2/2011 Swan et al.
2011/0126443 A1 6/2011 Sirois
2011/0192066 A1 8/2011 Kimmel et al.
2012/0042557 A1 2/2012 Gomez et al.
2012/0097807 A1 4/2012 Rees
2012/0124880 A1 5/2012 Leclair
2012/0167434 A1 7/2012 Masters
2012/0180359 A1 7/2012 Fitzpatrick et al.
2012/0186123 A1 7/2012 Troy et al.
2012/0311908 A1 * 12/2012 Kenney ..... F41A 21/482 42/75.02
2013/0031820 A1 2/2013 Deros
2013/0036646 A1 2/2013 Rubac et al.
2013/0104441 A1 5/2013 Kincel
2013/0133238 A1 5/2013 Quetschke
2013/0276341 A1 * 10/2013 Wells ..... F41G 11/003 42/71.01
2013/0318848 A1 12/2013 Kincel
2014/0000142 A1 1/2014 Patel
2014/0026459 A1 1/2014 Yan et al.
2014/0041273 A1 * 2/2014 Masters ..... F41C 23/16 42/71.01
2014/0082990 A1 3/2014 Lee
2014/0115938 A1 * 5/2014 Jarboe ..... F41A 21/485 42/71.01
2014/0115939 A1 5/2014 Troy et al.
2014/0115940 A1 5/2014 Bonelli et al.
2014/0130390 A1 5/2014 Geissele
2014/0204566 A1 7/2014 Kay
2014/0373419 A1 12/2014 Leclair
2015/0000171 A1 1/2015 Roberts
2015/0198408 A1 7/2015 Kincel et al.
2015/0219422 A1 8/2015 Kincel
2015/0267993 A1 9/2015 Cheng et al.
2015/0285583 A1 10/2015 Mayberry et al.
2015/0285584 A1 10/2015 Mayberry et al.
2015/0285585 A1 10/2015 Hewes et al.
2015/0316347 A1 * 11/2015 Shea ..... F41C 23/16 42/75.02
2015/0369555 A1 12/2015 Daniel et al.
2015/0369558 A1 12/2015 Gottzmann
2016/0010946 A1 * 1/2016 Gibbens ..... F41C 23/16 42/71.01
2016/0025120 A1 1/2016 Swan et al.
2016/0091277 A1 3/2016 Mayberry et al.
2016/0169617 A1 * 6/2016 Daley, Jr. ..... F41C 23/16 42/71.01
2016/0187100 A1 6/2016 Mayberry et al.
2016/0349011 A1 12/2016 Jen
2017/0016695 A1 1/2017 Willits
2017/0067718 A1 3/2017 Mayberry et al.
2017/0205183 A1 7/2017 Ding et al.
2017/0261276 A1 9/2017 Morris
2017/0307328 A1 10/2017 Shelton et al.
2018/0023919 A1 1/2018 Kincel et al.

* cited by examiner

FIREARM HANDGUARD ASSEMBLY

TECHNICAL FIELD

The present invention generally concerns firearm equipment. More particularly, the present invention relates to a firearm handguard assembly.

BACKGROUND

Traditionally, a handguard is mounted to a firearm using an assembly that uses a basic clamp on the handguard (which may or may not be integrated with the handguard itself) with a slice-bottom design, wherein the bottom portion of the clamp is held together with screws, a two-sided slice design, or a multi-part clamp design. When the screws are tightened, the clamp bears down on the handguard, holding the handguard to the barrel nut. The barrel nut holds the barrel of the firearm in place and is attached to the upper receiver. However, this design is problematic. The tension created by the clamp holds the handguard in place on the barrel nut, but places stress on the upper area of the handguard, which is weaker due to design constraints. This area expands as the clamping mechanism is tightened and more so when the firearm is in use due to the heat generated between the barrel of the firearm, which causes the stress imparted by the clamp to relax as the parts expand due to heat. Traditional designs have placed their hardware in a disadvantaged location due to the lack of clearance available between the various components on top of the barrel nut. There is, therefore, a need for an improved firearm handguard assembly system that obviates the shortcomings of the traditional clamping design.

Similarly, even when a handguard is properly mounted to a firearm, the movement of the handguard may loosen the barrel nut and could result in damage to the firearm. Several solutions have been offered to index the handguard to the upper receiver of the firearm. The most common solution is an anti-slip plate that is affixed to the barrel nut using several screws. This type of assembly can be complicated and time-consuming for the user. Yet another design is a handguard with an indexing tab (or "finger") that extends from the handguard and indexes to the upper receiver of the firearm. Therefore, there is a need for an indexing system that is simple and user-friendly.

The present invention is aimed at one or more of the problems identified above.

SUMMARY

In one aspect, the present invention provides a handguard assembly for a firearm including an upper receiver having a receiver rail and a barrel communicating with the upper receiver, the handguard assembly comprising: a barrel nut adapted for threaded engagement with the upper receiver to secure the barrel to the upper receiver, the barrel nut having an outer surface; a handguard including a handguard rail and a clamping area, the clamping area positioned around the outer surface of the barrel nut and the handguard rail extending away from the barrel nut; and a single-piece index block comprising a securing portion for connecting to the handguard and an indexing extension for engaging an indexing feature of the upper receiver, the securing portion and indexing extension both being integrally formed in the single-piece index block; wherein connecting the handguard to the securing portion of the index block causes the clamping area of the handguard to radially tighten on the outer surface of the barrel nut.

In some aspects of the invention, the handguard includes a plurality of internal ribs, each rib defining a discrete clamping surface and wherein the clamping area comprises the cumulative clamping area of the discrete clamping surfaces of the plurality of internal ribs. In some aspects of the invention, connecting the handguard to the securing portion of the index block generates a continuous clamping action in the handguard which acts through the ribs to apply a clamping force to the barrel nut through the discrete clamping surfaces. In some aspects of the invention, the barrel nut includes a circumferential groove in the outer surface and the index block includes a foot extending into the groove. In some aspects of the invention, the handguard includes a slot between the handguard rail and left and right sides of the handguard, the index block being positioned in the slot. In some aspects of the invention, the handguard further comprises at least one fastener extending through aligned apertures in the index block and the handguard, the at least one fastener being actuable to tighten the clamping area of the handguard with respect to the barrel nut. In some aspects of the invention, the indexing extension comprises a pair of indexing horns for engaging opposite sides of the receiver rail.

In another aspect, the invention provides a firearm comprising: an upper receiver having a receiver rail; a barrel communicating with the upper receiver; a barrel nut adapted for threaded engagement with the upper receiver to secure the barrel to the upper receiver, the barrel nut having an outer surface; a handguard including a handguard rail and a clamping area, the clamping area positioned around the outer surface of the barrel nut and the handguard rail extending away from the barrel nut; and a single-piece index block comprising an indexing extension engaging the receiver rail and a securing portion for connecting to the handguard, the indexing extension and securing portion being integrally formed in the single-piece index block; wherein connecting the handguard to the securing portion of the index block causes the clamping area of the handguard to radially tighten on the outer surface of the barrel nut.

In some aspects of the invention, the handguard includes a plurality of internal ribs, each rib defining a discrete clamping surface and wherein the clamping area comprises the cumulative clamping area of the discrete clamping surfaces of the plurality of internal ribs. In some aspects of the invention, connecting the handguard to the securing portion of the index block generates a continuous clamping action in the handguard which acts through the ribs to apply a clamping force to the barrel nut through the discrete clamping surfaces. In some aspects of the invention, the barrel nut includes a circumferential groove in the outer surface and the index block includes a foot extending into the groove. In some aspects of the invention, the handguard includes a slot between the handguard rail and left and right sides of the handguard, the index block being positioned in the slot. In some aspects of the invention, the firearm further comprises at least one fastener extending through aligned apertures in the index block and the handguard, the at least one fastener being actuable to tighten the clamping area of the handguard with respect to the barrel nut. In some aspects of the invention, the indexing extension comprises a pair of indexing horns for engaging opposite sides of the receiver rail.

BRIEF DESCRIPTION OF THE DRAWINGS

Other advantages of the present invention will be readily appreciated as the same becomes better understood by reference to the following detailed description when considered in connection with the accompanying drawings wherein.

Corresponding reference characters indicate corresponding parts throughout the drawings.

DETAILED DESCRIPTION

Embodiments of the present invention provide a handguard assembly and system and method of mounting the assembly to a firearm. Persons of ordinary skill in the art will realize that the following description of the presently invention is illustrative only and not in any way limiting. Other embodiments of the invention will readily suggest themselves to such skilled persons.

Other improved designs have included the use of clamp blocks, cross bolts, and an indexing plate, as described in U.S. Pat. No. 8,904,691, issued to Eric S. Kincel, which is incorporated herein by reference. The design of the present invention uses screws and an index clamp rather than cross bolts and a plurality of clamp blocks.

Figure 1A:
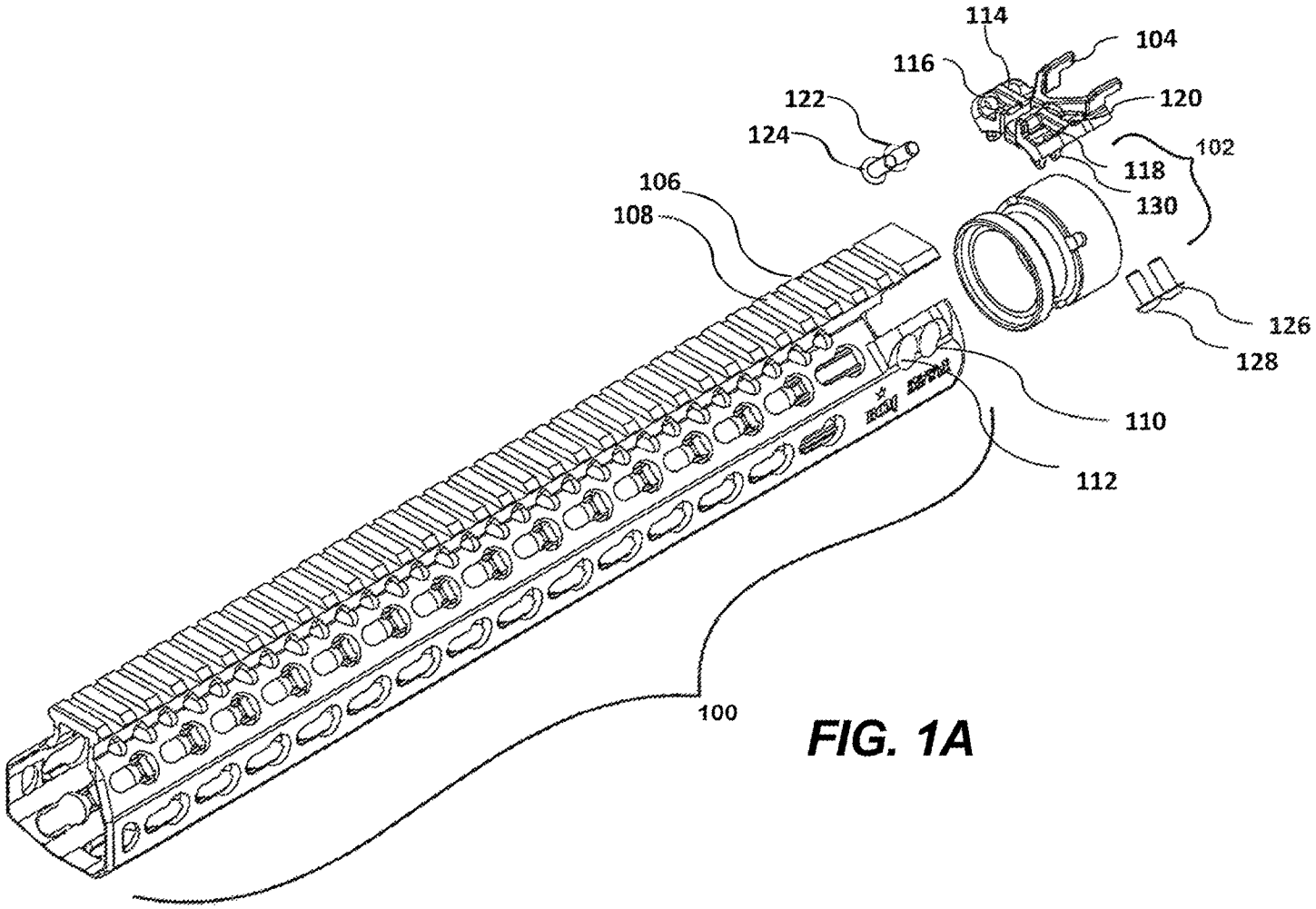
FIG. 1A illustrates an exploded view of an exemplary handguard assembly according to a first embodiment.

Referring now to FIG. 1A, illustrating an exploded view of a firearm handguard assembly system according to a first embodiment, a handguard 100 is coupled to a threaded end of barrel nut 102 to mount the upper receiver of a firearm (FIG. 1I) to handguard 100.

It is contemplated that any handguard may be used in connection with the present invention. In a preferred embodiment, the handguard is made from magnesium rather than aluminum, the typical material for handguards in the industry. Magnesium is lighter than aluminum by a ratio of 1:3, and is therefore an ideal structural material for handguards because it reduces strain on the firearm user during use. However, handguards made from any suitable structural material may be used in connection with the present invention, including without limitation steel (carbon and stainless), aluminum, and titanium.

It is also contemplated that the handguard may contain KeyMod holes, a picatinny rail (also known as a MIL-STD-1913 accessory rail), Magpul® M-LOK® System, GIBBZ Arms™ Modular Attachment (GAMA) System, and/or any other interface system currently available or later developed.

According to the first embodiment, the threaded end of barrel nut 102 is placed inside a first end of handguard 100. Without an index block or plate, the movement of the handguard may loosen the barrel nut and could result in damage to the firearm. Use of index block 104 eliminates rotation of handguard 100 during use.

A first end of handguard 100 contains a first aperture 106 and a second aperture 108 on a first side, and a third aperture 110 and a fourth aperture 112 on a second side. Index block 104 contains a first aperture 114 and a second aperture 116 on a first side, and a third aperture 118 and a fourth aperture 120 on a second side. Index block 104 is placed inside the first end of handguard 100 such that first aperture 114 of index block 104 is aligned with first aperture 106 of handguard 100 and second aperture 116 of index block 104 is aligned with second aperture 108 of handguard 100. On the second side of index block 104, third aperture 118 of index block 104 is aligned with third aperture 110 of handguard 100 and fourth aperture 120 of index block 104 is aligned with fourth aperture 112 of handguard 100.

A first screw 122 is threaded through first aperture 106 of handguard 100 and first aperture 114 of index block 104. A second screw 124 is threaded through second aperture 108 of handguard 100 and second aperture 116 of index block 104. A third screw 126 is threaded through third aperture 110 of handguard 100 and third aperture 118 of index block 104. A fourth screw 128 is threaded through fourth aperture 112 of handguard 100 and fourth aperture 120 of index block 104.

Index block 104 further includes feet, one of which is labeled 130, which interface with barrel nut 102.

During threading as described above, screws 122, 124, 126, and 128 preclude longitudinal movement of handguard 100, while clamping down on the body of handguard 100 to cause residual force between barrel nut 102 and handguard 100. On an AR-15 platform, the mounting force is spread around the firearm's gas tube 138 (see FIG. 1H). The residual mounting force prevents the handguard from flexing or growing, which ultimately prevents rotation and slippage during use.

Figure 1B:
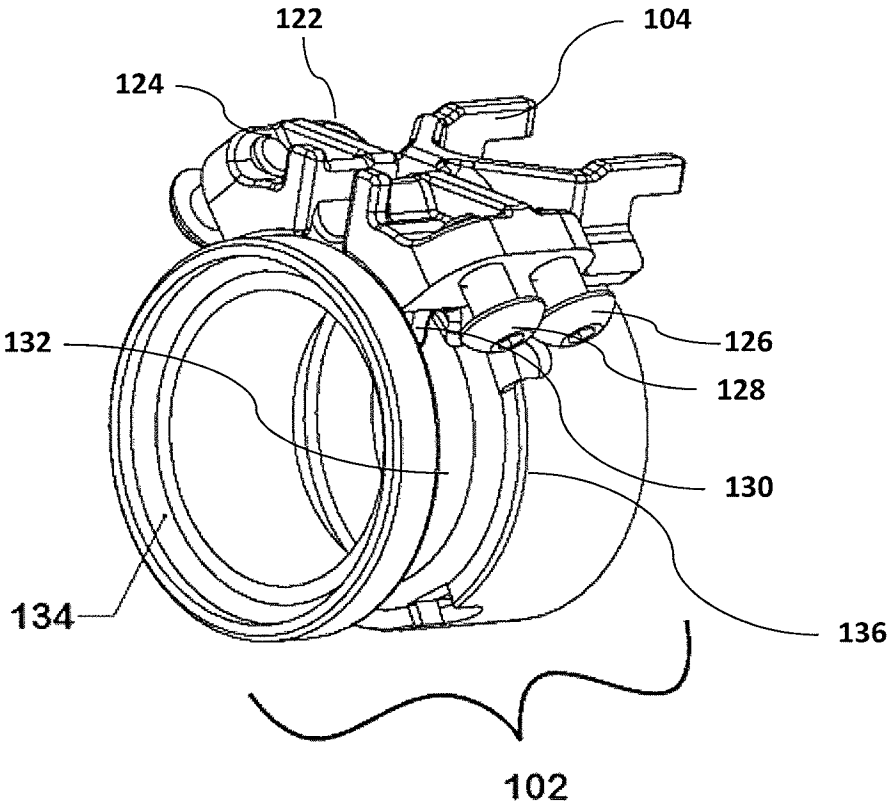
FIG. 1B illustrates a side perspective view of an index block of an exemplary handguard assembly according to a first embodiment.

Referring now to FIG. 1B, a side perspective view of index block 104 and barrel nut 102 of an exemplary handguard assembly according to the first embodiment is shown. Screws 122, 124, 126, and 128 are threaded through index block 104. Feet 130 of index block 104 interface with barrel nut 102 in a groove 132 between a first lip 134 of the threaded end barrel nut 102 and a second lip 136 of the smooth end of barrel nut 102.

Figure 1D:
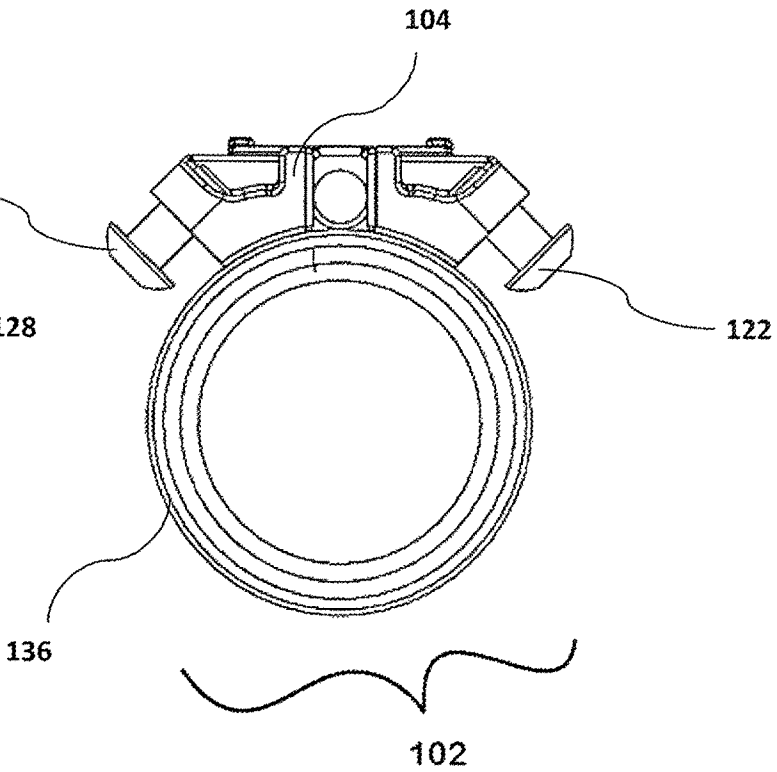
FIG. 1D illustrates a back view of an index block and a barrel nut of an exemplary handguard assembly according to a first embodiment.
Figure 1C:
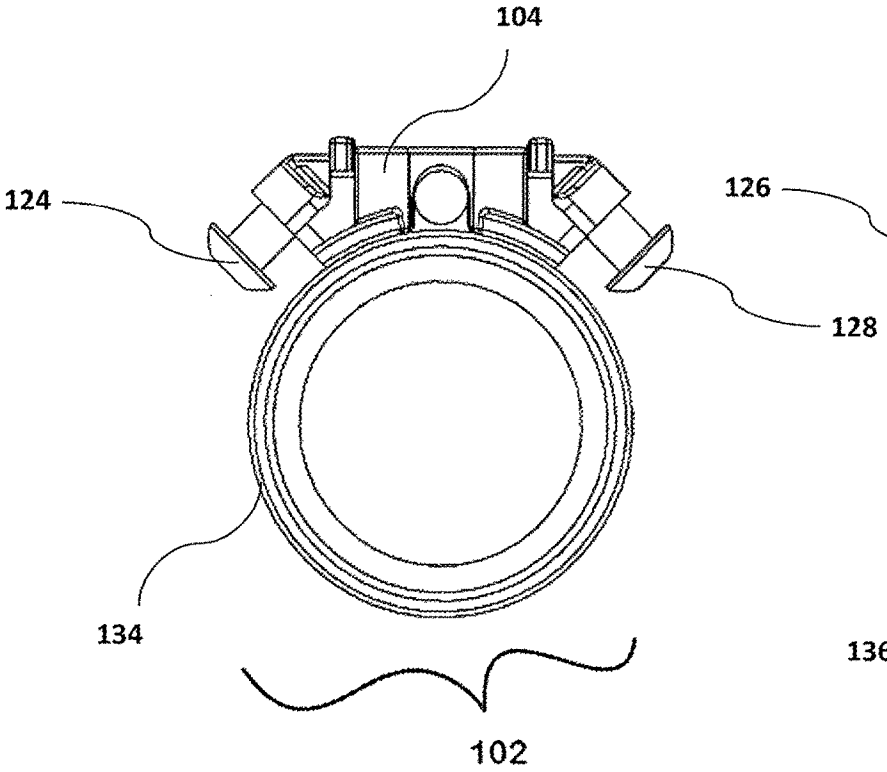
FIG. 1C illustrates a front view of an index block and a barrel nut of an exemplary handguard assembly according to a first embodiment.

Referring now to FIGS. 1C and 1D, a front view and a back view of index block 104 and barrel nut 102 of an exemplary handguard assembly according to the first embodiment are shown, respectively.

Figure 1F:
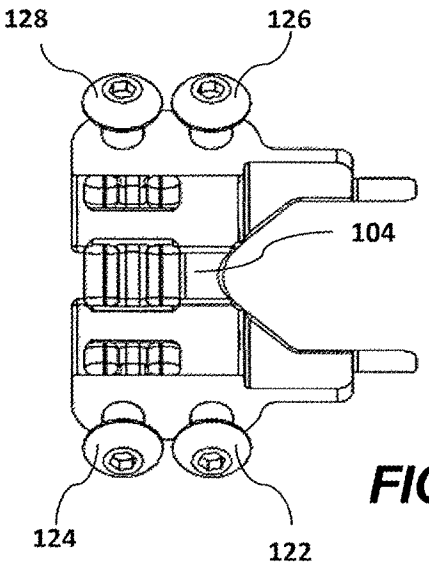
FIG. 1F illustrates a bottom view of an index block of an exemplary handguard assembly according to a first embodiment.
Figure 1E:
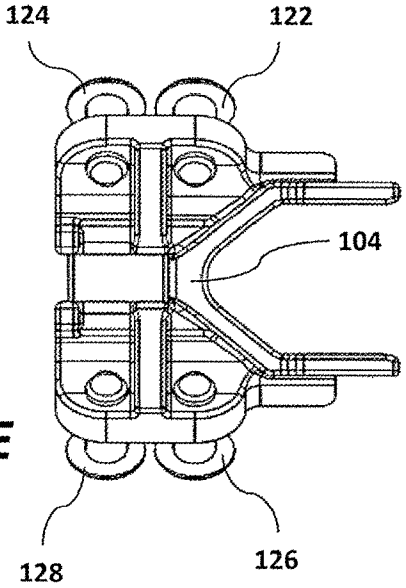
FIG. 1E illustrates a top view of an index block of an exemplary handguard assembly according to a first embodiment.

Referring now to FIGS. 1E and 1F, a top view and a bottom view of index block 104 of an exemplary handguard assembly according to the first embodiment are shown, respectively.

Figure 1G:
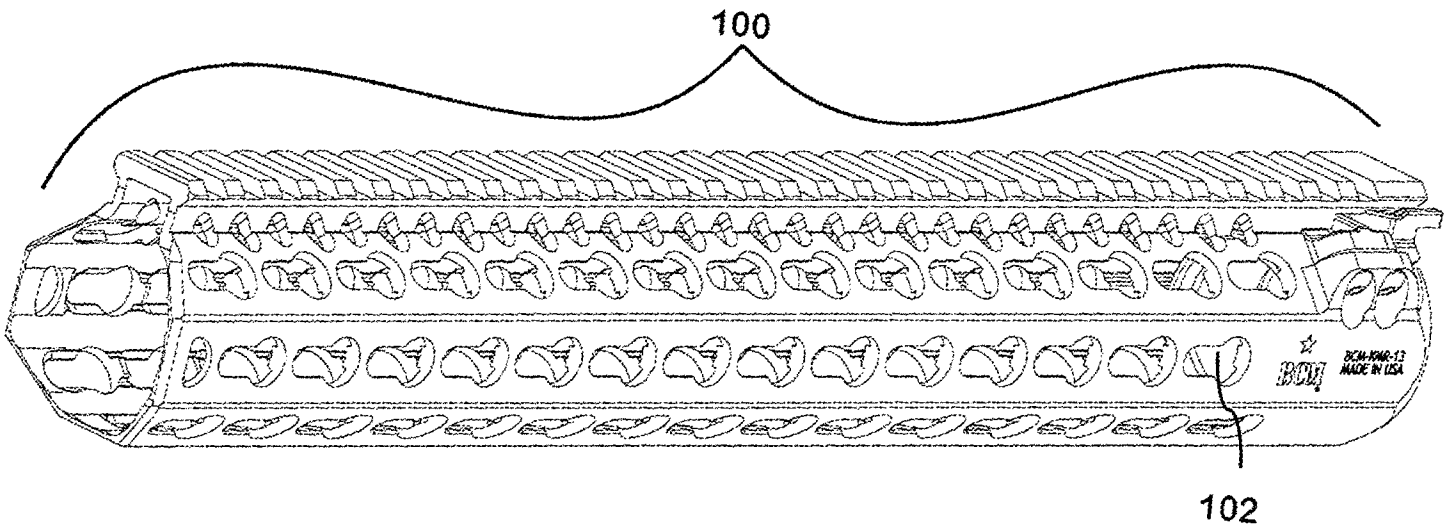
FIG. 1G illustrates a perspective view of a fully assembled exemplary handguard assembly system according to a first embodiment.
Figure 1H:
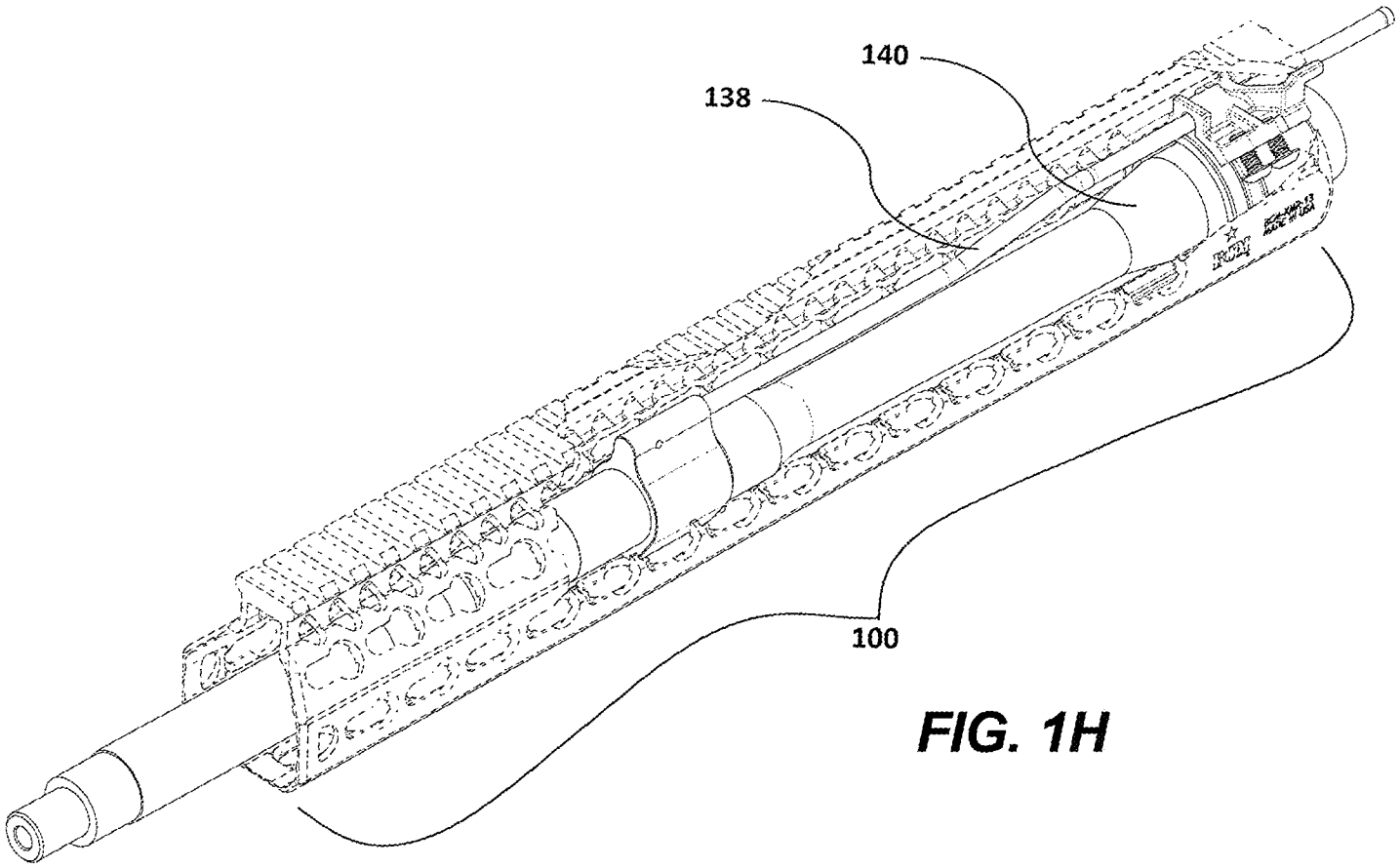
FIG. 1H illustrates a cross-sectional view of a of a fully assembled exemplary handguard assembly system according to a first embodiment.
Figure 1I:
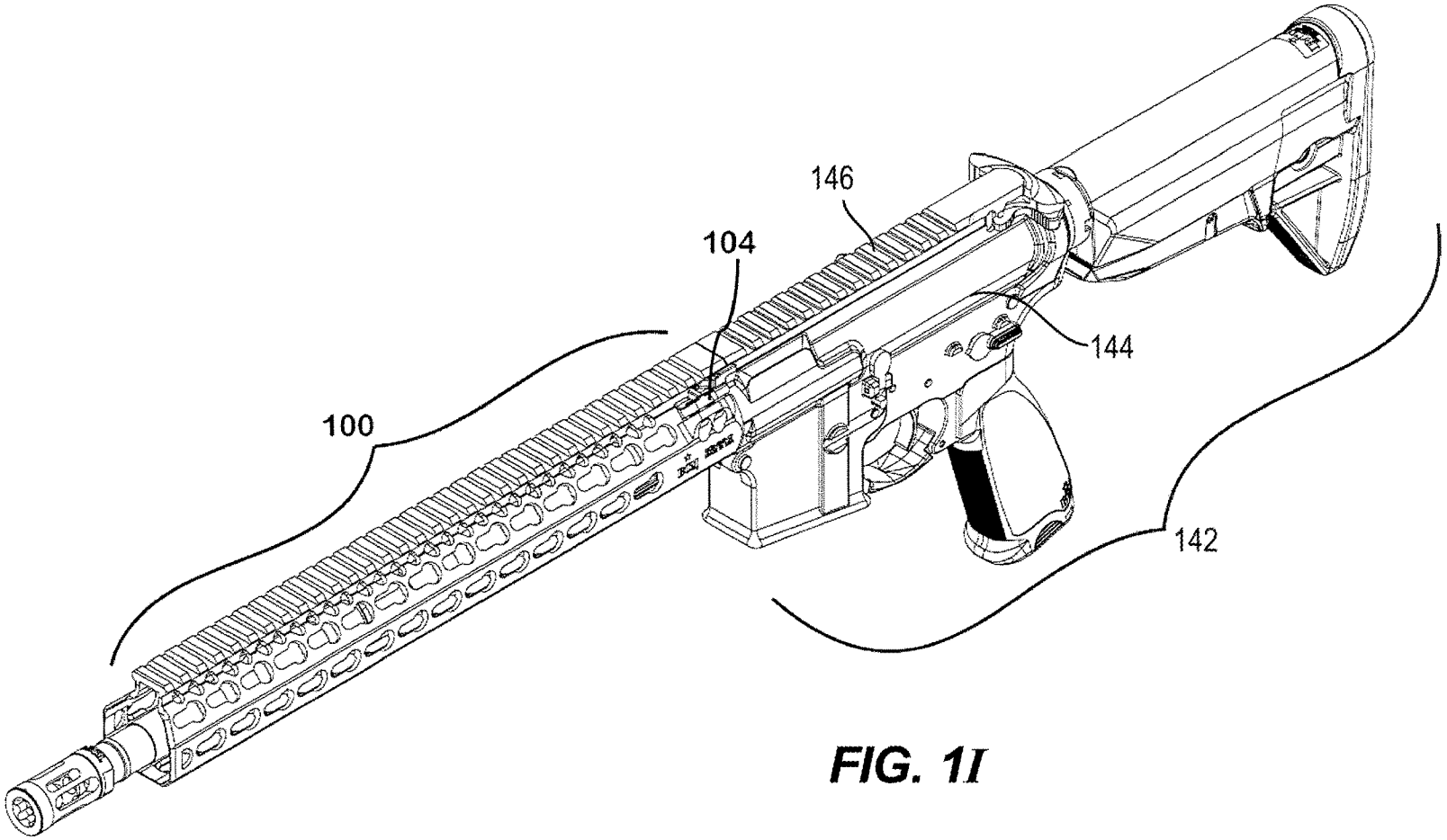
FIG. 1I illustrates a fully assembled firearm handguard assembly system on an exemplary firearm according to a first embodiment.

Referring now to FIG. 1G, illustrating a fully assembled firearm handguard assembly system according to the first embodiment, the barrel nut 102 is secured inside handguard 100 with screws 122, 124, 126, and 128, and with index block 104 in place, allowing handguard 100 to be fully indexed to the upper receiver of the firearm (FIG. 1I). The design of the firearm handguard assembly strengthens the grip of the handguard on the barrel nut, by eliminating non-continuous features within the clamping area of the handguard body, keeping the handguard tensioned in place even under high stress and heat when the firearm is in use.

Referring now to FIG. 1H, illustrating a cross-sectional view of a fully assembled exemplary handguard assembly system according to the first embodiment, the handguard 100 includes gas tube 138 and barrel 140.

Referring now to FIG. 1I, illustrating a fully assembled firearm handguard on an exemplary firearm 142 according to the first embodiment. The firearm 142 includes an upper receiver 144 having a receiver rail 146 to which accessories can be mounted. The illustrated receiver rail 146 is in the form of a Picatinny rail but could be provided in different forms known in the art. The handguard 100 is secured to exemplary firearm 142 at its upper receiver 144 with index block 104 and screws 122, 124, 126, and 128 in place.

Figure 2A:
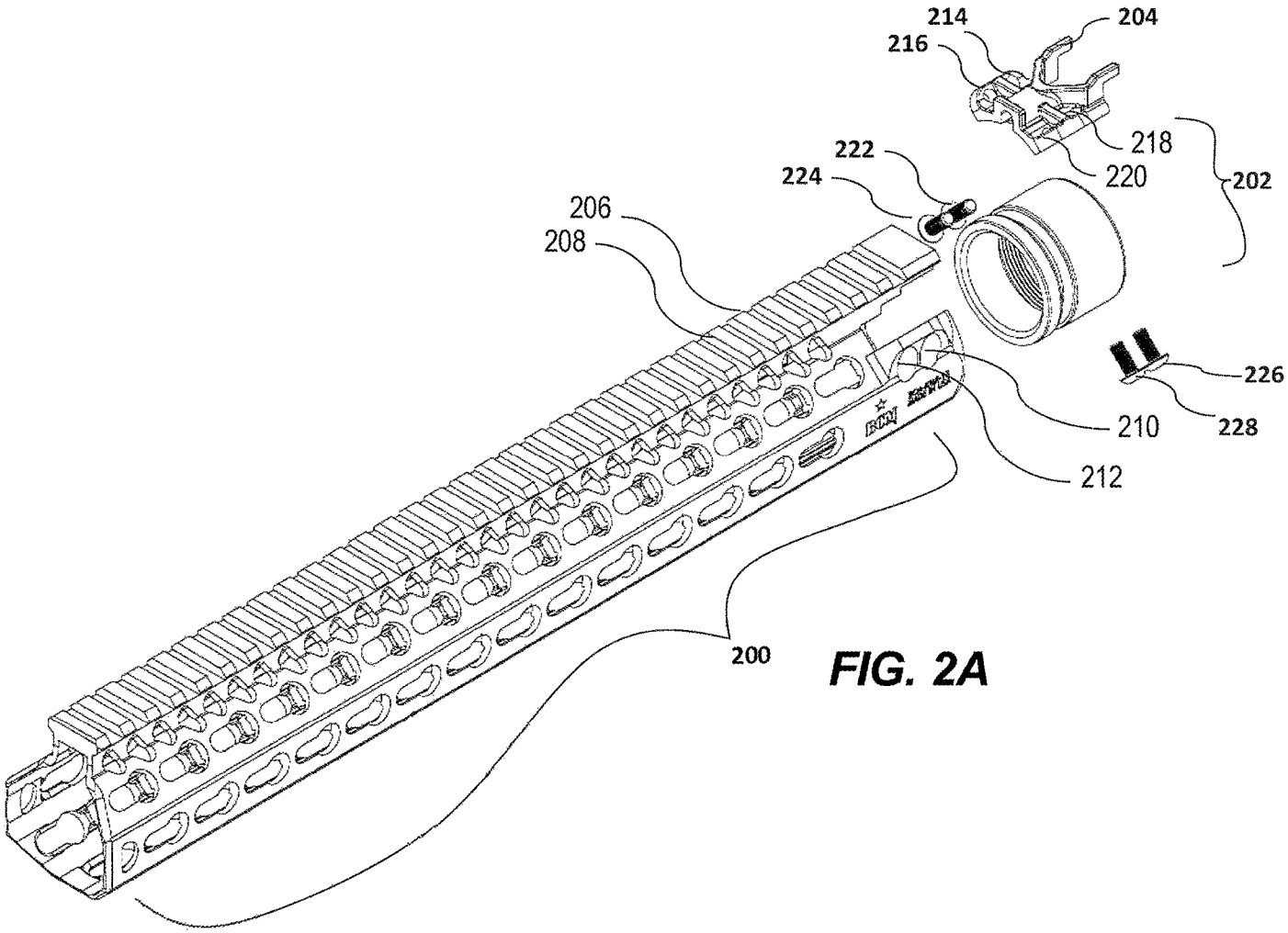
FIG. 2A illustrates an exploded view of an exemplary handguard assembly according to a second embodiment.

Referring now to FIG. 2A, illustrating an exploded view of a firearm handguard assembly system according to a second embodiment, a handguard 200 is coupled to a threaded end of barrel nut 202 to mount the upper receiver of a firearm (FIG. 2I) to handguard 200.

The threaded end of barrel nut 202 is placed inside a first end of handguard 200. Without an index block or plate, the movement of the handguard may loosen the barrel nut and could result in damage to the firearm. Use of index block 204 eliminates rotation of handguard 100 during use.

A first end of handguard 200 contains a first aperture 206 and a second aperture 208 on a first side, and a third aperture 210 and a fourth aperture 212 on a second side. Index block 204 contains a first aperture 214 and a second aperture 216 on a first side, and a third aperture 218 and a fourth aperture 220 on a second side. Index block 204 is placed inside the first end of handguard 200 such that first aperture 214 of index block 204 is aligned with first aperture 206 of handguard 200 and second aperture 216 of index block 204 is aligned with second aperture 208 of handguard 200. On the second side of index block 204, third aperture 218 of index block 204 is aligned with third aperture 210 of handguard 200 and fourth aperture 220 of index block 204 is aligned with fourth aperture 212 of handguard 200.

A first screw 222 is threaded through first aperture 206 of handguard 200 and first aperture 214 of index block 204. A second screw 224 is threaded through second aperture 208 of handguard 200 and second aperture 216 of index block 204. A third screw 226 is threaded through third aperture 210 of handguard 200 and third aperture 218 of index block 204. A fourth screw 228 is threaded through fourth aperture 212 of handguard 200 and fourth aperture 220 of index block 204.

During threading as described above, screws 222, 224, 226, and 228 preclude longitudinal movement of handguard 200, while clamping down on the body of handguard 200 to cause residual force between barrel nut 202 and handguard 200. On an AR-10 platform, the mounting force is spread under the gas tube 238 (see FIG. 2H). The residual mounting force prevents the handguard from flexing or growing, which ultimately prevents rotation and slippage during use.

Figure 2B:
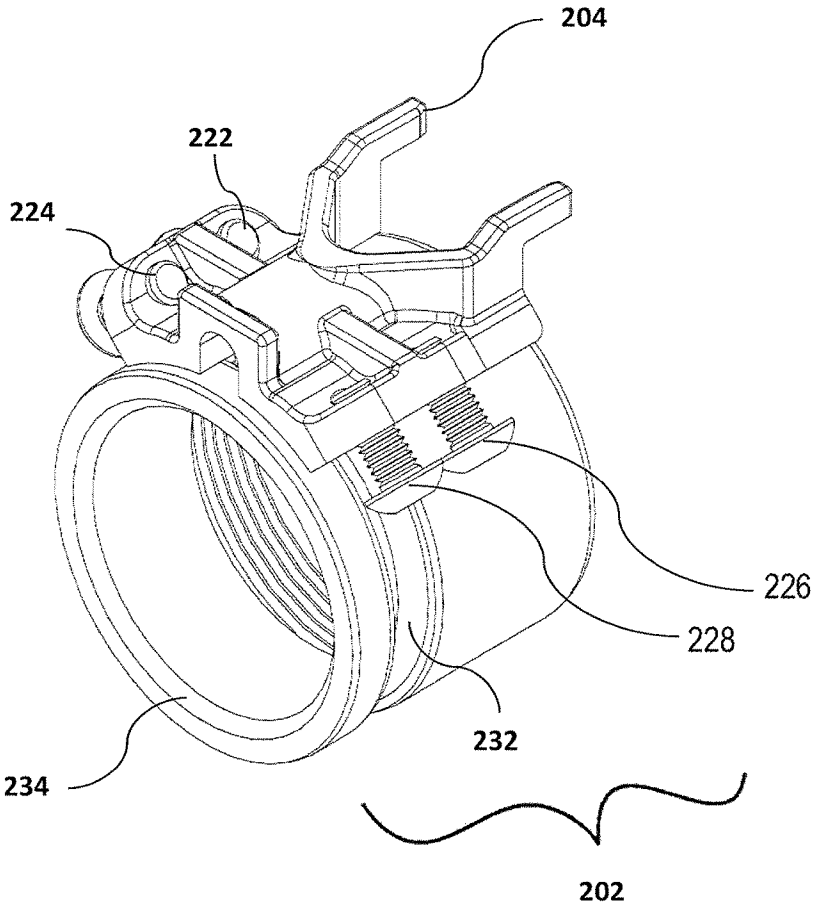
FIG. 2B illustrates a side perspective view of an index block of an exemplary handguard assembly according to a second embodiment.

Referring now to FIG. 2B, a side perspective view of index block 204 and barrel nut 202 of an exemplary handguard assembly according to the second embodiment is shown. Screws 222, 224, 226, and 228 are threaded through index block 204. Index block 204 interfaces with barrel nut 202 in a groove 232 between a first lip 234 of the threaded end barrel nut 202 and a second lip 236 of the smooth end of barrel nut 202.

Figure 2D:
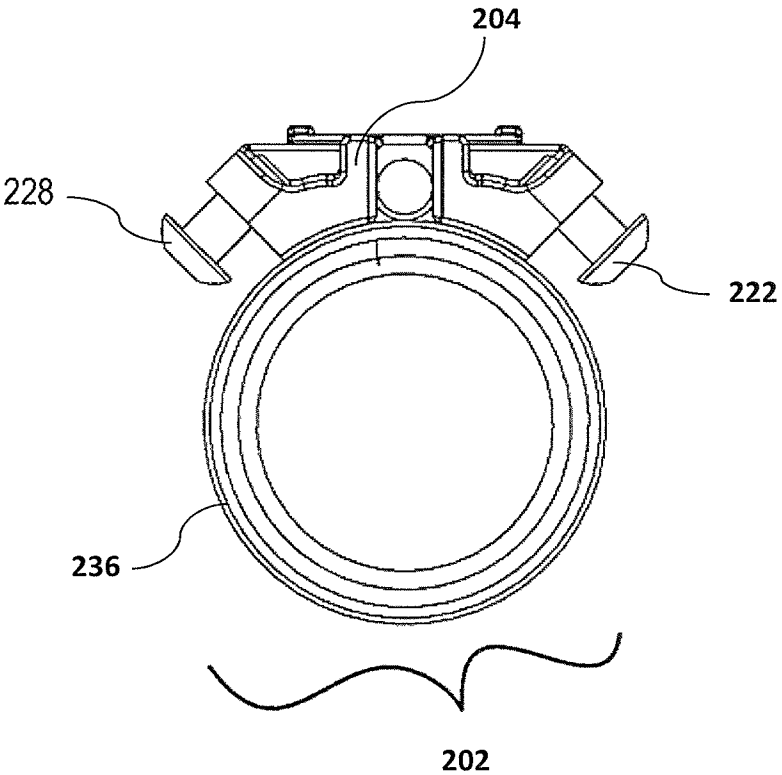
FIG. 2D illustrates a back view of an index block and a barrel nut of an exemplary handguard assembly according to a second embodiment.
Figure 2C:
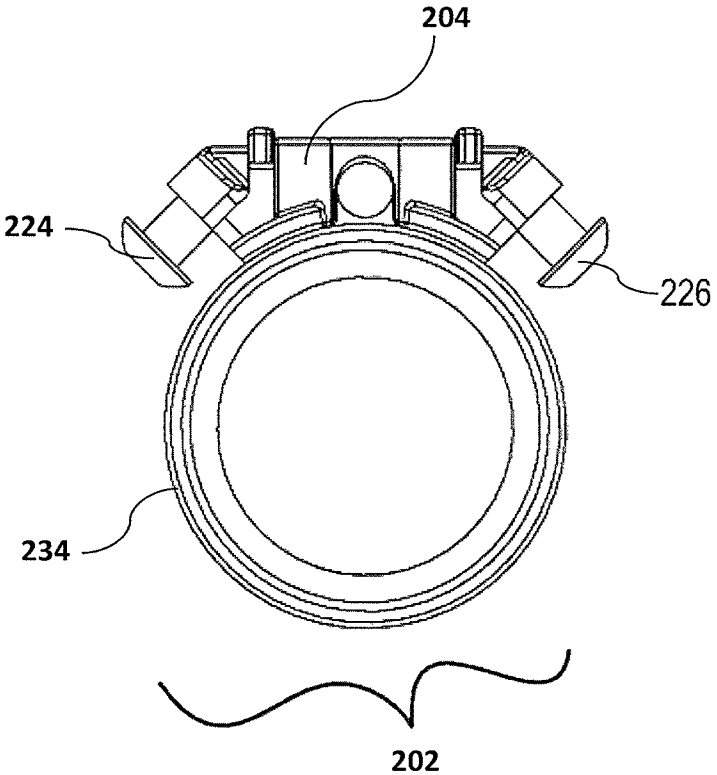
FIG. 2C illustrates a front view of an index block and a barrel nut of an exemplary handguard assembly according to a second embodiment.

Referring now to FIGS. 2C and 2D, a front view and a back view of index block 204 and barrel nut 202 of an exemplary handguard assembly according to the second embodiment are shown, respectively.

Figure 2F:
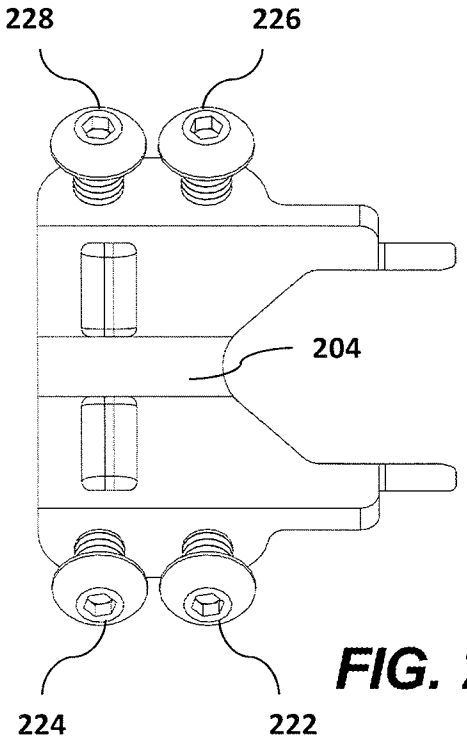
FIG. 2F illustrates a bottom view of an index block of an exemplary handguard assembly according to a second embodiment.
Figure 2E:
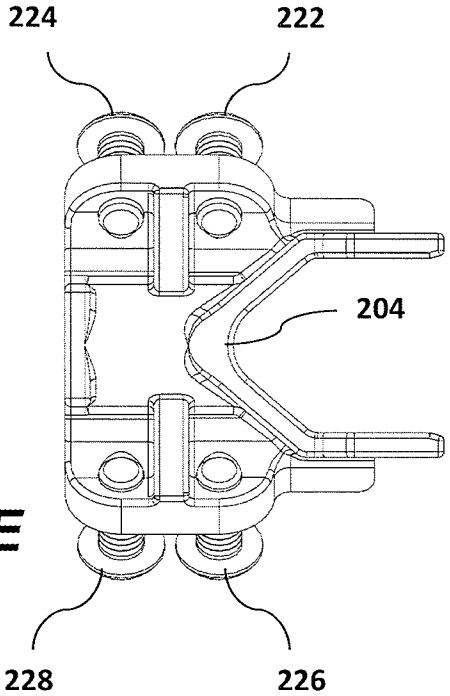
FIG. 2E illustrates a top view of an index block of an exemplary handguard assembly according to a second embodiment.

Referring now to FIGS. 2E and 2F, a top view and a bottom view of index block 204 of an exemplary handguard assembly according to the second embodiment are shown, respectively.

Figure 2G:
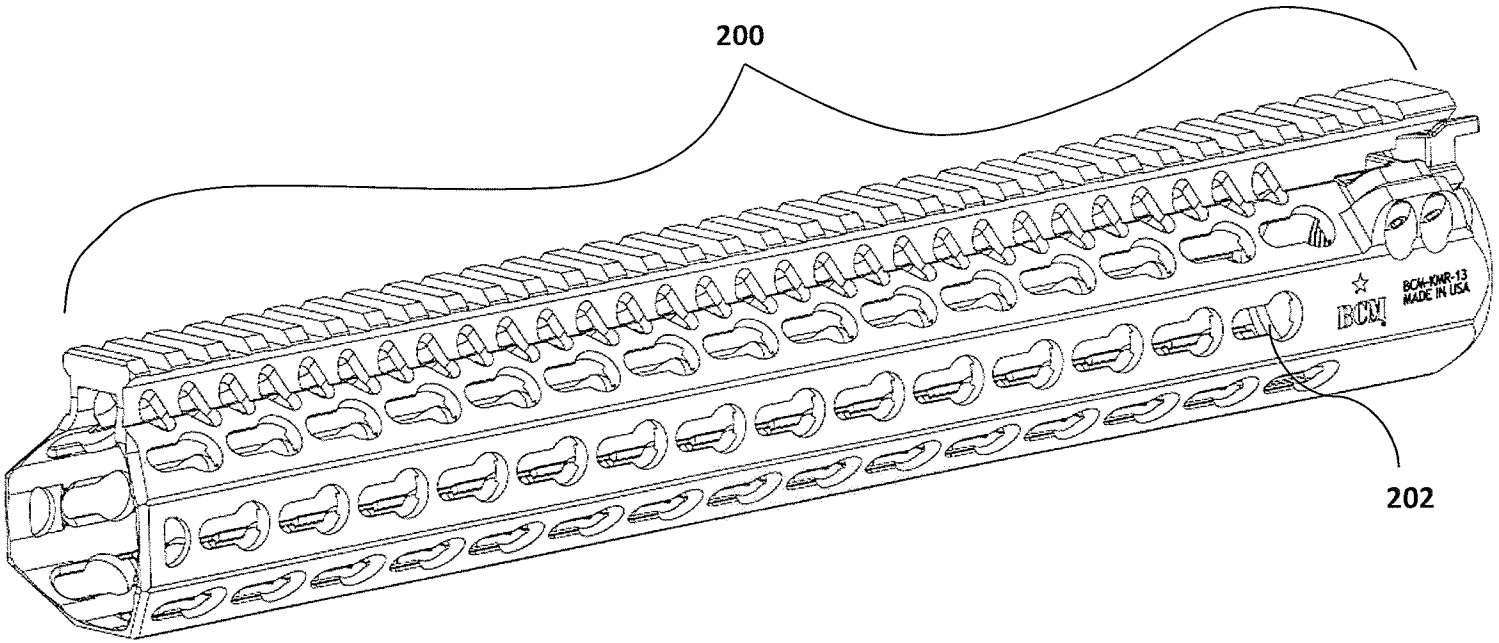
FIG. 2G illustrates a perspective view of a fully assembled exemplary handguard assembly system according to a second embodiment.
Figure 2H:
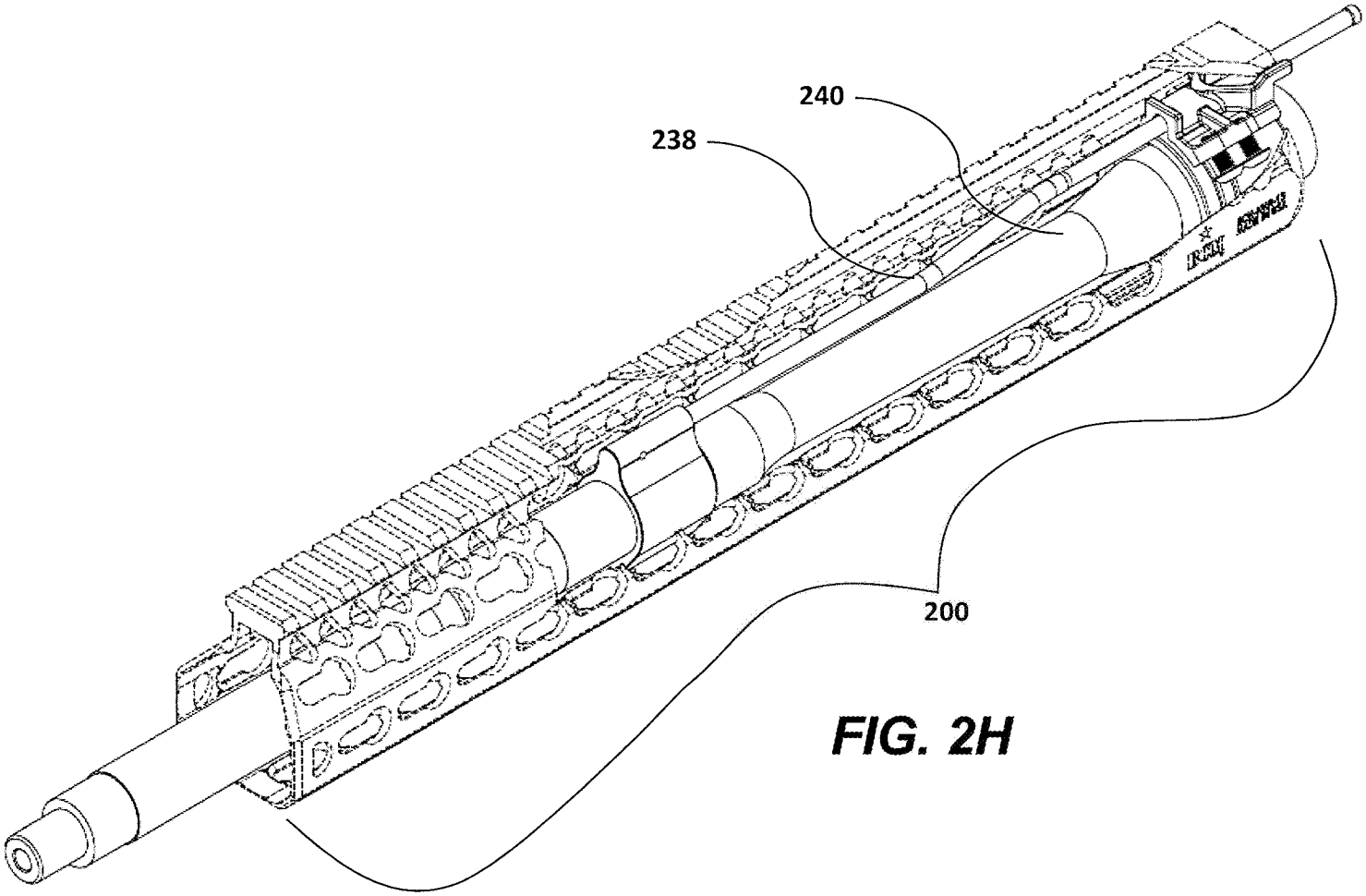
FIG. 2H illustrates a cross-sectional view of a of a fully assembled exemplary handguard assembly system according to a second embodiment.
Figure 2I:
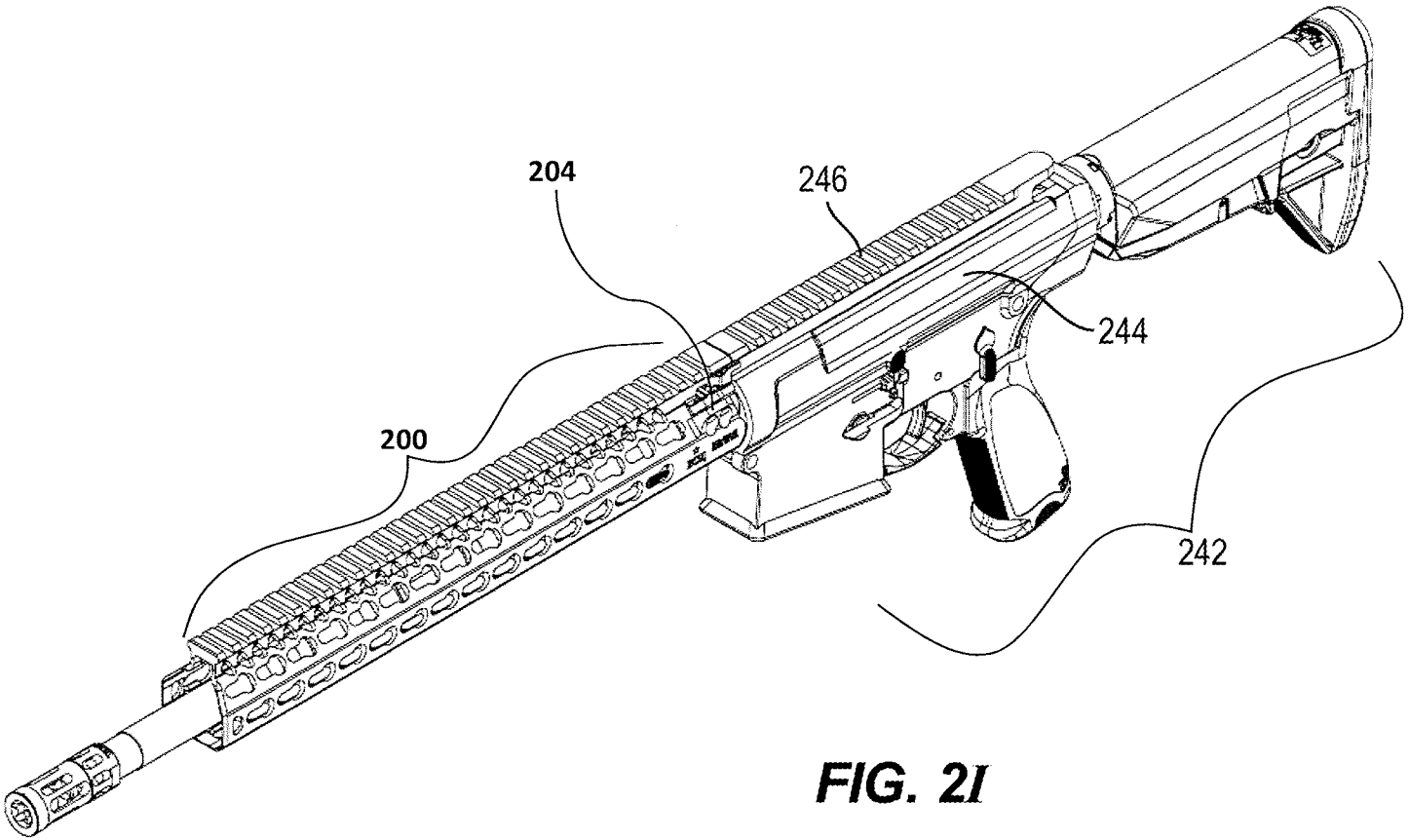
FIG. 2I illustrates a fully assembled firearm handguard assembly system on an exemplary firearm according to a second embodiment.

Referring now to FIG. 2G, illustrating a fully assembled firearm handguard assembly system according to the second embodiment, the barrel nut 202 is secured inside handguard 200 with screws 222, 224, 226, and 228, and with index block 204 in place, allowing handguard 200 to be fully indexed to the upper receiver of the firearm (see FIG. 2I). The design of the firearm handguard assembly strengthens the grip of the handguard on the barrel nut, by eliminating non-continuous features within the clamping area of the handguard body, keeping the handguard tensioned in place even under high stress and heat when the firearm is in use.

Referring now to FIG. 2H, illustrating a cross-sectional view of a fully assembled exemplary handguard assembly system according to the second embodiment, the handguard 200 includes gas tube 238 and barrel 240.

Referring now to FIG. 2I, illustrating a fully assembled firearm handguard on an exemplary firearm 242 according to the second embodiment. The firearm 242 is the same as the firearm 142 described above and includes an upper receiver 244 with a receiver rail 246. The same description of these features above applies to firearm 242. The handguard 200 is secured to exemplary firearm 242 at its upper receiver 244 with index block 204 and screws 222, 224, 226, and 228 in place.

An exemplary firearm may be an AR-10, AR-15, or a variant thereof. The present invention may also be used with any firearm that uses a threaded portion of the forward area of the upper receiver and/or action over which may pass any portion of the operating assembly. By way of example, and not limitation, these firearms may include bolt action rifles for which the user may desire a handguard or fore-end with a top rail and superior clamping force to the receiver.

Exemplary embodiments are illustrated herein. The first embodiment, illustrated by FIGS. 1A-1I, shows the present invention on an AR-15 platform. The second embodiment, illustrated by FIGS. 2A-2B, shows the present invention on the AR-10 platform.

Although the exemplary embodiments described herein contain a block and screw assembly that requires one block and four screws, it is contemplated that more or less than four screws may be used. It is also contemplated that the block may be integrated into the handguard body.

The barrel nuts shown in FIGS. 1A-1I and FIGS. 2A-2I use a radial groove long and deep enough to pass a multitude of screws. Alternative embodiments of the barrel nut include, but are not limited to, a barrel nut design containing a plurality of apertures to allow the screws to pass through the apertures and engage the index block; a barrel nut design with a plurality of flat cuts that create clearance for the screws to pass; a barrel nut design with no forward flange but with a protrusion to support the screws; a barrel nut design without any forward flange, no clearance cuts, and which may have screws passing only in front of, or in front of and behind, the barrel nut in order to engage the apertures on either side of the handguard. The barrel nut and related metal mounting hardware made from any suitable structural material may be used in connection with the present invention, including without limitation steel (carbon and stainless) and titanium.

Figure 3A:
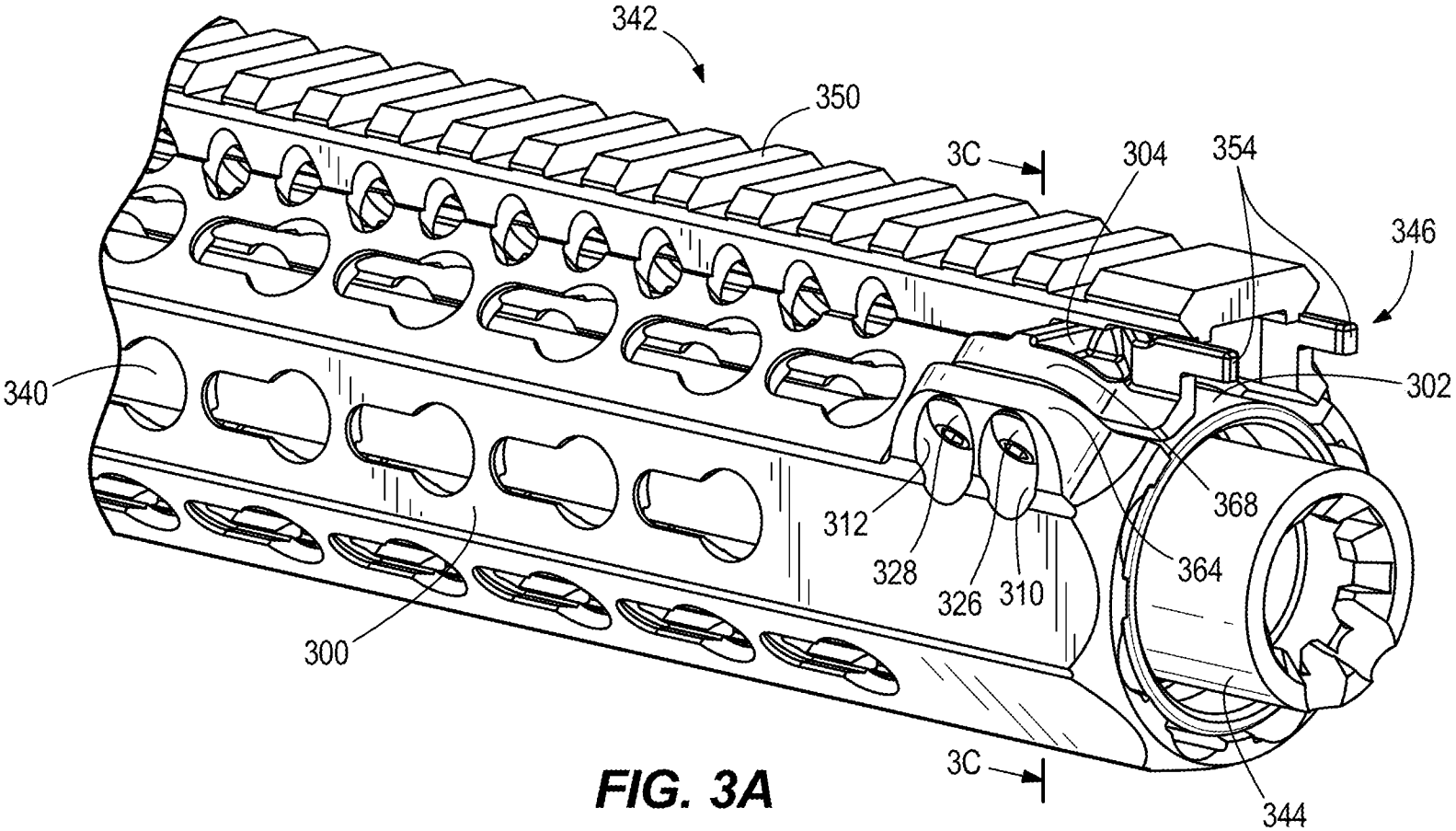
FIG. 3A is a perspective end view of a handguard assembly system according to a third embodiment.
Figure 3B:
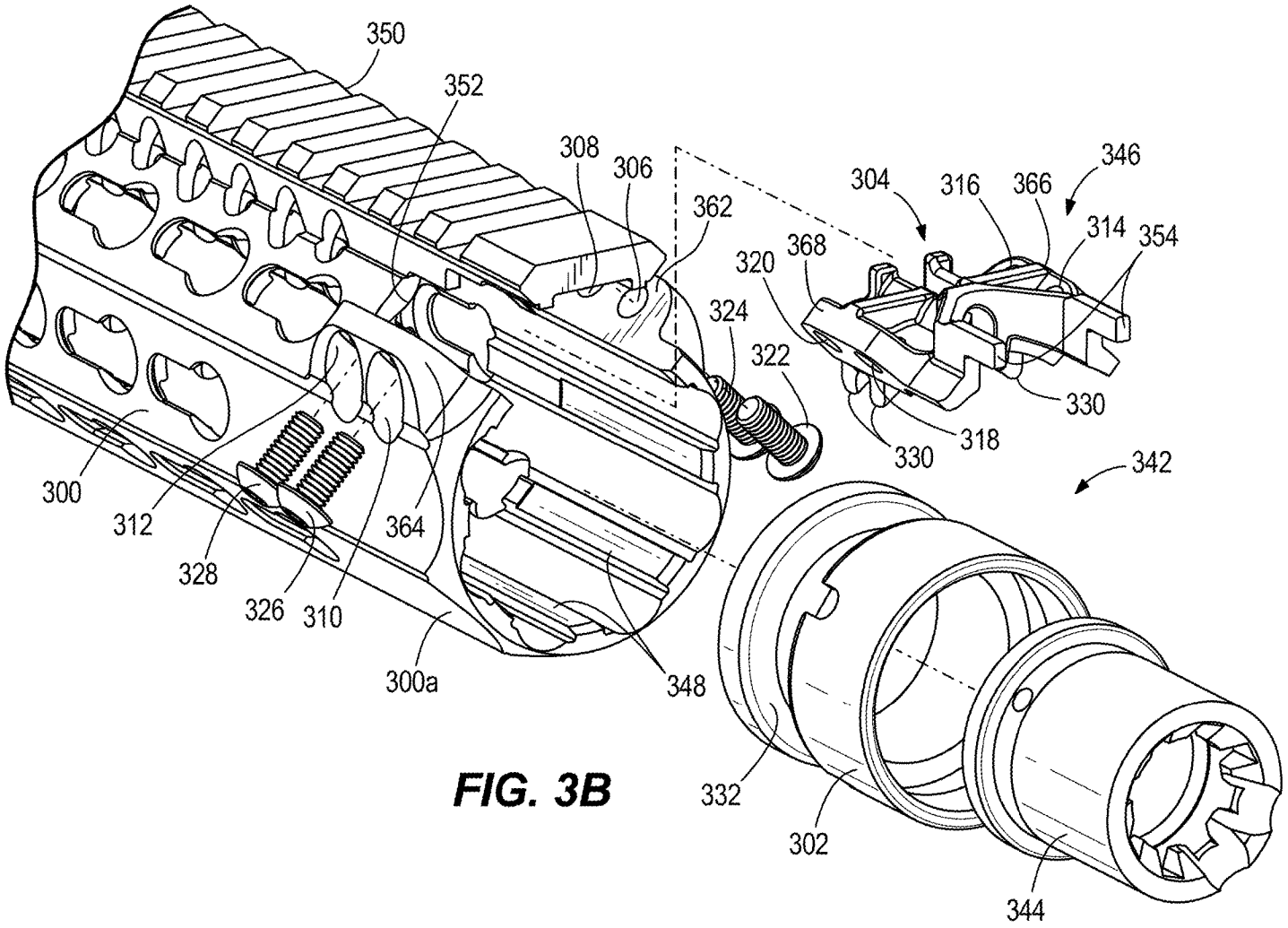
FIG. 3B is an exploded view of the system of FIG. 3A.
Figure 3C:
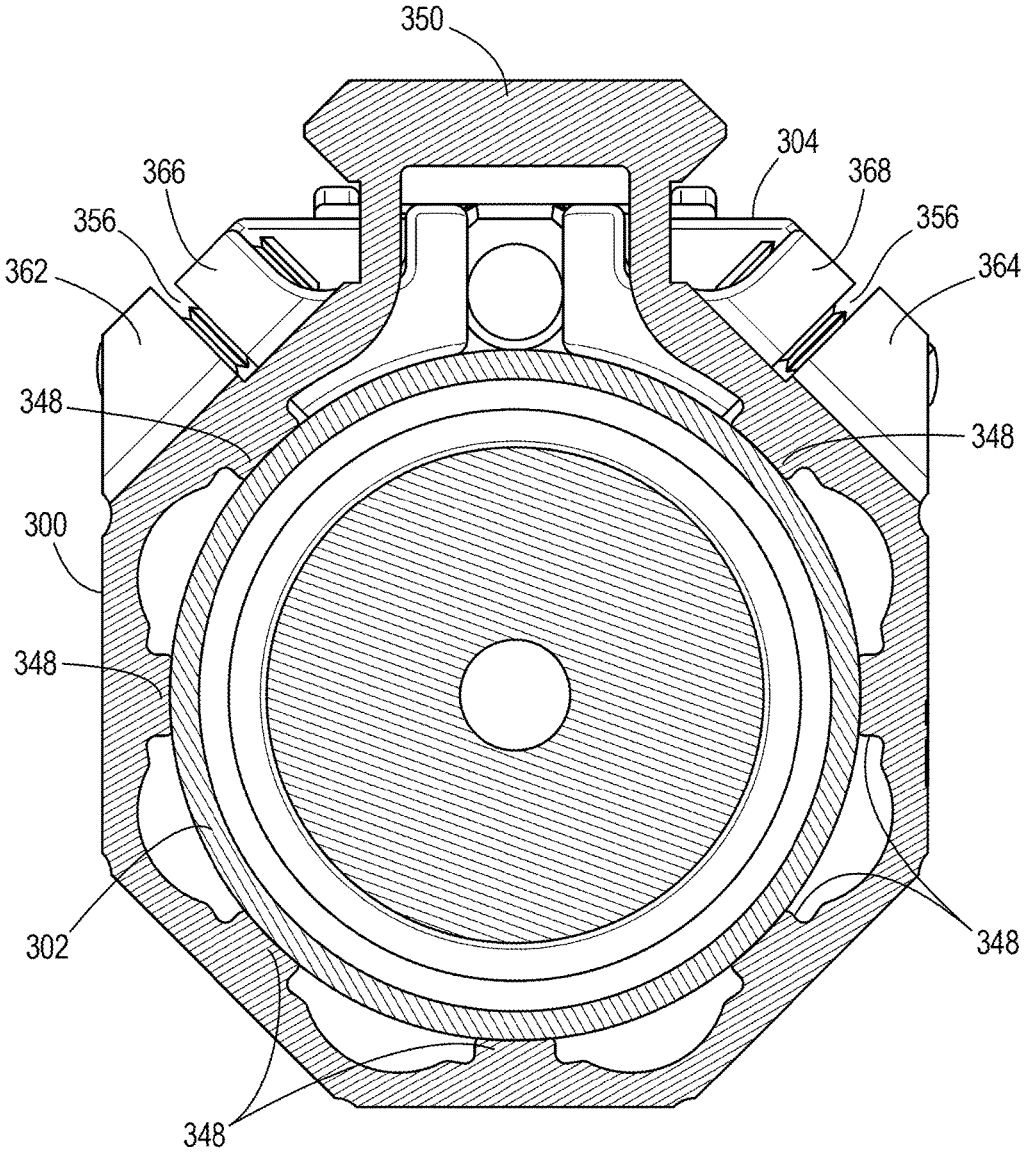
FIG. 3C is a cross-section view taken along line 3-3 in FIG. 3A.

FIGS. 3A-3C illustrate a third embodiment of a firearm handguard assembly system 346 according to the present invention. The third embodiment of the firearm handguard assembly system 346 is for use with a firearm 342 similar or identical to the firearms 142, 242 described above. The firearm 342 includes an upper receiver having a receiver rail similar or identical to the upper receivers 144, 244 and receiver rails 146, 246 described above. The firearm 342 also includes a barrel nut 302 and a barrel 340 which are identical to the corresponding parts described above with respect to the firearms 142, 242. The barrel nut 302, for example, has a circumferential groove 332 in its outer surface. The illustrated barrel 340 includes a barrel extension 344 which includes locking lugs for the firearm's bolt. The barrel nut 302 securely mounts the barrel 340 to the upper receiver of the firearm 342.

The handguard assembly system 346 includes a handguard 300 and an index block 304. The handguard 300 includes internal ribs 348 that provide discrete clamping surfaces for clamping against the outer surface of the barrel nut 302 at discrete clamping locations around the circumference of the barrel nut 302. This is different from the substantially continuous clamping surfaces provided by the internal surfaces of the handguards 100, 200 described above. The internal ribs 348 can be provided with less material than is required to provide the substantially continuous clamping surface of the handguards 100, 200 described above. The handguard 300 consequently may be lighter than handguards 100, 200.

All handguard embodiments 100, 200, 300 of the present invention provide a clamping area around the outer surface of the barrel nut 102, 202, 302 for a radially-directed circumferentially-applied clamping force from the handguard 100, 200, 300 onto the barrel nut 102, 202, 302, but whereas the clamping area of the first two embodiments 100, 200 is continuous, the clamping area of the third embodiment 300 is the cumulative clamping area of the discrete clamping surfaces provided by the ribs 348.

Other than the ribs 348 in place of a substantially continuous clamping surface, the handguard 300 is identical or substantially similar to the handguards 100, 200 described above. For example, the handguard 300 includes a Picatinny rail 350 or other accessory mounting rail which aligns with a receiver rail on the upper receiver when the handguard is properly mounted to the upper receiver. A first end **300*a* of the handguard 300 includes a slot 352 between the Picatinny rail 350 and the tops of the right and left sides of the handguard 300. The tops of the right and left sides of the handguard 300 define respective first and second mounting flanges 362, 364. The first end 300*a* includes first and second smooth apertures (i.e., through bores) 306, 308 through the first mounting flange 362, and third and fourth smooth apertures (i.e., through bores) 310, 312 through the second mounting flange 364**.

The index block 304 is identical or substantially similar to the index blocks 104, 204 described above. The index block 304 includes first and second securing portions 366, 368 on the respective right and left sides of the index block 304. The securing portions 366, 368 are the sides or wings of the index block 304. The index block 304 further includes first and second threaded apertures 314, 316 in the first securing portion 366, and third and fourth threaded apertures 318, 320 in the second securing portion 368.

The index block 304 also includes a plurality of feet 330 for engaging the barrel nut 302 and a pair of indexing horns 354 to engage an upper receiver indexing feature (e.g., the receiver rail, other accessory mounting rail, or any other feature of the upper receiver). The feet 330 and indexing horns 354 are integrally formed (e.g., molded or cast) with the rest of the index block 304 such that the index block is a single-piece index block 304. It will be understood that the feet 330 and indexing horns 354 could alternatively be any suitable features for engaging the barrel nut 302 and an indexing feature of the upper receiver, as will be explained in more detail below.

The process for installing the handguard assembly system 346 on the firearm 342 is identical to the process described above, but will be briefly described again here. To install the handguard assembly system 346 on the firearm 342, the index block 304 is positioned on the barrel nut 302 with the feet 330 in the groove 332. The index block 304 and barrel nut 302 are then inserted into the first end **300*a* of the handguard 300 to insert the first and second securing portions 366, 368 in the slot 352. The barrel nut 302 and index block 304 are positioned in the first end 300*a* to align the first, second, third, and fourth threaded apertures 314, 316, 318, 320 of the index block 304 with the respective first, second, third, and fourth smooth apertures 306, 308, 310, 312 of the handguard 300. When initially installed, there is a gap 356 (FIG. 3C) between the first and second securing portions 366, 368 of the index block 304 and the respective first and second mounting flanges 362, 364 of the first end 300*a* of the handguard 300**.

First, second, third, and fourth screws 322, 324, 326, 328 are extended through the respective first, second, third, and fourth smooth apertures 306, 308, 310, 312 and threaded into the respective first, second, third, and fourth threaded apertures 314, 316, 318, 320. As the screws 322, 324, 326, 328 are tightened, the heads of the screws 322, 324, 326, 328 bear against the outside surface of the mounting flanges 362, 364, thereby narrowing the gaps 356. As the gaps 356 narrow, the top left and right sides of the first end **300*a* of the handguard 300 are drawn toward each. This results in a clamping action which is applied to the outer surface of the barrel nut 302 through the discrete clamping surfaces of the ribs 348**.

Like the first two embodiments described above, the clamping action of the handguard assembly system 346 is continuous in the sense that there is circumferential tension through the whole left and right sides of the first end 300*a*. The left and right sides of the first end 300*a* of the handguard 300 act like a continuous band clamp or a strap. Unlike the two embodiments 100, 200 described above, however, the continuous clamping action of the handguard 300 is applied to the barrel nut 302 through the discrete clamping surfaces of the internal ribs 348. Thus, the continuous clamping action provides discrete, separate clamping forces spaced circumferentially around the outer surface of the barrel nut 302. The discrete, separate clamping forces of the handguard assembly system 346 generate sufficient friction to prevent rotation and axial (i.e., along the length of the barrel 340) movement of the handguard 300 with respect to the barrel nut 302.

As noted above, the feet 330 could alternatively be any suitable feature for engaging the barrel nut 302 such that the index block 304 is properly positioned on the barrel nut 302 for assembly into the handguard 300. The engagement of the feet 330 in the groove 332 provides additional resistance against axial movement of the index block 304 and handguard 300 with respect to the barrel nut 302.

Likewise, the indexing horns 354 could alternatively be replaced with any suitable configuration for engaging an indexing feature of the upper receiver 144, 244. In the illustrated embodiments, the indexing horns 354 engage opposite sides of the receiver rail 146, 246 so that the handguard 100, 200, or 300 is properly clocked or indexed to the upper receiver 144, 244 (e.g., so that the handguard rail 350 aligns with the receiver rail 146, 246) during installation. In other embodiments, the indexing horns 354 could be replaced with any suitable indexing extension that engages an indexing feature of the upper receiver 144, 244. For example, the indexing feature could be a single extension or finger on the index block 304 that engages a hole or groove in the upper receiver 144, 244. In addition to indexing the handguard 100, 200, or 300 to the upper receiver 144, 244, the indexing horns 354 provide some resistance to rotational movement of the handguard 300 with respect to the barrel nut 302.

The above description is illustrative and not restrictive. Many variations of the invention will become apparent to those of skill in the art upon review of this disclosure. While the present invention has been described in connection with a variety of embodiments, these descriptions are not intended to limit the scope of the invention to the particular forms set forth herein. To the contrary, the present descriptions are intended to cover alternatives, modifications, and equivalents as may be included within the spirit and scope of the invention as defined by the appended claim and otherwise appreciated by one of ordinary skill in the art.

What is claimed is:

1. A handguard assembly for a firearm including an upper receiver having a receiver rail and a barrel communicating with the upper receiver, the handguard assembly comprising:

a barrel nut adapted for threaded engagement with the upper receiver to secure the barrel to the upper receiver, the barrel nut having an outer surface;

a handguard including a handguard rail and a clamping area, the clamping area positioned around the outer surface of the barrel nut and the handguard rail extending away from the barrel nut; and a single-piece index block comprising a securing portion for connecting to the handguard and an indexing extension for engaging an indexing feature of the upper receiver, the securing portion and indexing extension both being integrally formed in the single-piece index block;

wherein connecting the handguard to the securing portion of the index block causes the clamping area of the handguard to radially tighten on the outer surface of the barrel nut; and wherein the handguard includes a plurality of internal ribs, each rib defining a discrete clamping surface and wherein the clamping area comprises the cumulative clamping area of the discrete clamping surfaces of the plurality of internal ribs.

2. The handguard assembly of claim 1, wherein connecting the handguard to the securing portion of the index block generates a continuous clamping action in the handguard which acts through the ribs to apply a clamping force to the barrel nut through the discrete clamping surfaces.

3. The handguard assembly of claim 1, wherein the barrel nut includes a circumferential groove in the outer surface and the index block includes a foot extending into the groove.

4. The handguard assembly of claim 1, wherein the handguard includes a slot between the handguard rail and left and right sides of the handguard, the index block being positioned in the slot.

5. The handguard assembly of claim 1, further comprising at least one fastener extending through aligned apertures in the index block and the handguard, the at least one fastener being actuable to tighten the clamping area of the handguard with respect to the barrel nut.

6. The handguard assembly of claim 1, wherein the indexing extension comprises a pair of indexing horns for engaging opposite sides of the receiver rail.

7. A firearm comprising:

an upper receiver having a receiver rail;

a barrel communicating with the upper receiver;

a barrel nut adapted for threaded engagement with the upper receiver to secure the barrel to the upper receiver, the barrel nut having an outer surface;

a handguard including a handguard rail and a clamping area, the clamping area positioned around the outer surface of the barrel nut and the handguard rail extending away from the barrel nut; and a single-piece index block comprising an indexing extension engaging the receiver rail and a securing portion for connecting to the handguard, the indexing extension and securing portion being integrally formed in the single-piece index block;

wherein connecting the handguard to the securing portion of the index block causes the clamping area of the handguard to radially tighten on the outer surface of the barrel nut; and wherein the handguard includes a plurality of internal ribs, each rib defining a discrete clamping surface and wherein the clamping area comprises the cumulative clamping area of the discrete clamping surfaces of the plurality of internal ribs.

8. The firearm of claim 7, wherein connecting the handguard to the securing portion of the index block generates a continuous clamping action in the handguard which acts through the ribs to apply a clamping force to the barrel nut through the discrete clamping surfaces.

9. The firearm of claim 7, wherein the barrel nut includes a circumferential groove in the outer surface and the index block includes a foot extending into the groove.

10. The firearm of claim 7, wherein the handguard includes a slot between the handguard rail and left and right sides of the handguard, the index block being positioned in the slot.

11. The firearm of claim 7, further comprising at least one fastener extending through aligned apertures in the index block and the handguard, the at least one fastener being actuable to tighten the clamping area of the handguard with respect to the barrel nut.

12. The firearm of claim 7, wherein the indexing extension comprises a pair of indexing horns for engaging opposite sides of the receiver rail.

13. A handguard assembly for a firearm including an upper receiver having a receiver rail and a barrel communicating with the upper receiver, the handguard assembly comprising:

a barrel nut adapted for threaded engagement with the upper receiver to secure the barrel to the upper receiver, the barrel nut having an outer surface;

a handguard including a handguard rail and a clamping area, the clamping area positioned around the outer surface of the barrel nut and the handguard rail extending away from the barrel nut; and a single-piece index block comprising a securing portion for connecting to the handguard and an indexing extension for engaging an indexing feature of the upper receiver, the securing portion and indexing extension both being integrally formed in the single-piece index block;

wherein connecting the handguard to the securing portion of the index block causes the clamping area of the handguard to radially tighten on the outer surface of the barrel nut; and wherein the indexing extension comprises a pair of indexing horns for engaging opposite sides of the receiver rail.

14. The handguard assembly of claim 13, wherein the handguard includes a plurality of internal ribs, each rib defining a discrete clamping surface and wherein the clamping area comprises the cumulative clamping area of the discrete clamping surfaces of the plurality of internal ribs.

15. The handguard assembly of claim 14, wherein connecting the handguard to the securing portion of the index block generates a continuous clamping action in the handguard which acts through the ribs to apply a clamping force to the barrel nut through the discrete clamping surfaces.

16. The handguard assembly of claim 13, wherein the barrel nut includes a circumferential groove in the outer surface and the index block includes a foot extending into the groove.

17. The handguard assembly of claim 13, wherein the handguard includes a slot between the handguard rail and left and right sides of the handguard, the index block being positioned in the slot.

18. The handguard assembly of claim 13, further comprising at least one fastener extending through aligned apertures in the index block and the handguard, the at least one fastener being actuable to tighten the clamping area of the handguard with respect to the barrel nut.

* * * * *